United States Patent [19]

Richardson

[11] 4,309,125

[45] Jan. 5, 1982

[54] INTEGRATED BRIDGE CONSTRUCTION

[76] Inventor: George S. Richardson, 2670 Spring Grove Ter., Colorado Springs, Colo. 80906

[21] Appl. No.: 194,564

[22] Filed: Oct. 6, 1980

[51] Int. Cl.[3] ..... E01D 19/12

[52] U.S. Cl. ..... 14/73; 52/447

[58] Field of Search ..... 404/70; 14/73; 52/447, 52/454, 443, 600

[56] References Cited

U.S. PATENT DOCUMENTS

| | | | |
|---|---|---|---|
| 1,645,622 | 10/1927 | Prince | 14/73 X |
| 1,739,102 | 12/1929 | Strauss | 14/73 |
| 1,898,668 | 2/1933 | Jones | 52/447 X |
| 1,929,478 | 10/1933 | Bunker | 404/70 X |
| 1,936,536 | 11/1933 | Bates | 14/73 X |
| 2,017,832 | 10/1935 | Hovey | 14/73 X |
| 2,211,513 | 8/1940 | Nagin | 14/73 X |
| 3,286,421 | 11/1966 | Branstrator | 52/600 X |

OTHER PUBLICATIONS

American Bridge Division (United States Steel); Catalog "I-Beam-Lok"; pp. 6, 7, 12, 13.

*The Pittsburgh Press;* Mar. 25, 1969; Captioned Photograph.

Greulich Catalog No. 5.6a/Gr-1; pp. 3, 5, 6, 7, 8, 10, 11, 12, 13, 14, 15.

Reliance Catalog No. 5.6/Reo; pp. 3, 4, 5, 6, 7, 8, 10, 11, 12, 13.

*Primary Examiner*—Nile C. Byers, Jr.

*Attorney, Agent, or Firm*—Gary M. Polumbus

[57] ABSTRACT

A bridge construction includes a bridge deck having a grid system of longitudinally extending members and criss-crossing transverse members supported at a vertically spaced relationship above a base plate. The grid system and base plate are integrally supported by a floor system and main support members. The base plate and grid system act as reinforcements for a fill material like concrete.

15 Claims, 11 Drawing Figures

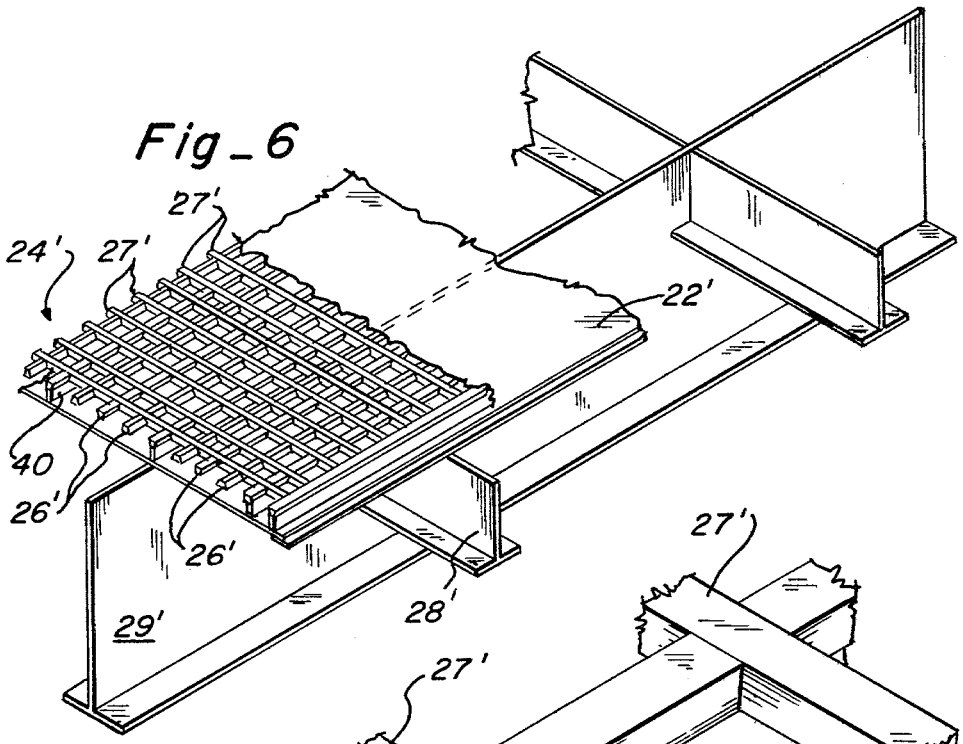
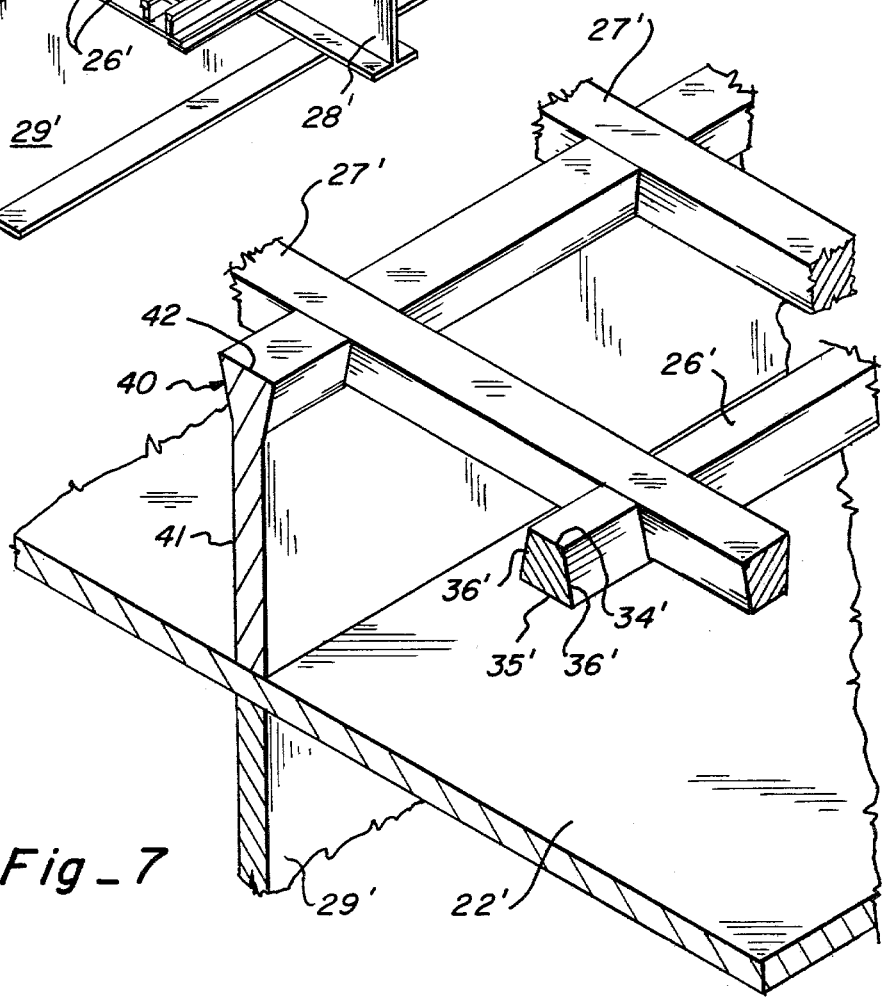
Fig_7

INTEGRATED BRIDGE CONSTRUCTION

BACKGROUND OF THE INVENTION

1. Field of Invention

The present invention relates generally to bridge construction of the type using a concrete filled steel grid system for a deck and more particularly to bridge construction of the aforedescribed type utilizing a continuous base plate in the deck to which the grid system, floor system, and main supporting members are integrally connected.

2. Brief Description of the Prior Art

The concrete slab has been the most commonly used type of construction for highway bridge decks. Unfortunately, but realistically, this is not a completely satisfactory construction for a highway bridge deck. Concrete is a material well suited to carry loads in compression but, in addition to compressive loads, bridge decks are inevitably exposed to loads causing tensile stresses in certain areas on both the top and bottom of the concrete slab and concrete is not a very strong material under tensile stresses. Additional forces are applied to the concrete slab as a result of exposure to weather and large temperature variations which cause cyclic contraction and expansion. Also, concrete shrinks as it cures and ages. These conditions (temperature variations, shrinkage and loading) cause cracks in the top and bottom surfaces of concrete slabs. Continued exposure to temperature changes, and in most climates, numerous cycles of freezing and thawing over the years, cause further cracking and spalling of concrete bridge decks.

In some measure the cracking can be controlled, but not entirely eliminated, by steel reinforcement. The use of steel reinforcement embedded within a concrete slab presents a conflict to the bridge engineer. To be most effective in preventing cracking the reinforcement should be placed as near the surface of the concrete as possible. However, to prevent intrusion of moisture and corrosion of the steel, which can cause cracking in time, the steel reinforcement should be placed with as much concrete cover as possible. Corrosion of the steel reinforcement is one of the principal causes of deterioration of concrete bridge decks so prevalent in recent years with the increasing use of chlorides for de-icing. This is a major economic problem with highway bridge construction. An investigation in recent years reported that there were more than 50,000 bridge decks on the federal highway requiring major repairs or replacement, many in bridges with less than fifteen years service.

In recent years various procedures have been used to alleviate the problem of deck deterioration. These have included: (1) More concrete cover of the steel reinforcing; (2) protection of the steel by galvinizing or coating with epoxy; and (3) water-proofing the concrete slab. All of these procedures add very substantially to the direct cost of the bridge deck and indirectly to the cost of the remainder of the structure because of increased dead loads.

Concrete filled steel grid decks have given superior service and durability compared to the more common used concrete slab. An example of such a bridge deck is made by the American Bridge Division of United States Steel Corporation which for many years has made available a $4\frac{1}{4}$ inch or 3 inch concrete filled I-Beam-Lok bridge flooring. The flooring consists of a combination of special I-beams running longitudinally of the bridge, intersected at right angles with transverse cross bars.

Metal form strips are placed between the I-beams and rest on the lower flanges of the I-beams. The transverse cross bars are securely interlocked with the main carrying I-beam. It is further specified that the entire unit be welded to the supporting members and concrete poured to a position flush with the top flange of the I-beams or to a three-quarter inch overfill above the top flange of the I-beams.

A shortcoming of the prior I-beam grid decks lies in the necessity to enhance the strength of the grid system in the lateral direction of the I-beams. This problem has previously been addressed by utilizing an upper and a lower set of cross bars so that continuous cross bar steel is maintained at both the top and bottom of the slab. Even with the additional set of cross bars, strength of the grid deck in a direction transverse to the I-beams is not as high for the weight of steel present as can be achieved.

A continuous base plate to which studs are welded and onto which concrete is poured has been utilized by a French bridge designer to form a bridge deck. Such a bridge deck has some of the advantages of the present invention, as for example in the use of a continuous base plate. This plate, however, is not stiffened by a grid system as in the present invention. Also, the concrete fill over the base plate has all the inherent shortcomings of the conventional concrete slab.

OBJECTS AND SUMMARY OF THE INVENTION

The principal object of the present invention is to provide a new and improved bridge construction utilizing a concrete and steel bridge deck that will insure long term durability of the deck with low cost of maintenance at a more economical total cost of structure than possible with previous deck systems.

A related object of the invention is to provide a new and improved bridge construction utilizing a concrete and steel bridge deck structure that effectively resists lateral and longitudinal forces and resulting compression and tension stresses.

A further related object of the invention is to provide a new and improved bridge construction utilizing a concrete and steel bridge deck that is highly resistent to corrosion from chlorides and forces resulting from cyclic thermal changes.

A further object of the invention is to provide a new and improved bridge construction utilizing a concrete and steel bridge deck that is both strong and relatively lightweight.

In accordance with the objects of the invention, it will become apparent from the detailed description hereinafter that the bridge construction of the invention has been designed to include five basic features. The first four of these features are found in a bridge deck which includes: (1) A base plate with welded sealed joints forming the entire bottom surface of the deck. This base plate provides sealing against seepage of moisture through the deck and consequent protection of all structures under the deck. (2) A top grid system forming small geometrical areas. This grid system along with the base plate and the connection system to be set forth hereinafter, provide equal strength in both longitudinal and lateral directions. (3) A connection system between the base plate and the grid system which may take numerous forms to provide shear transfer between the base plate and the grid system in both longitudinal and lateral directions. (4) A concrete fill supported by the base plate and being flush with the upper surface of the grid system.

The fifth feature of the present invention is a completely integrated connection between the bridge deck composed of the four features mentioned above and supporting members which utilize the bridge deck as the top flange thereof.

The bridge construction utilizing the five features mentioned hereinbefore will be seen to include a continuous base plate rigidly connected to a superimposed criss-crossing grid system of longitudinal and tranverse members, and an integrated underlying support system for the deck system. The base plate and the manner in which the base plate is connected to the grid system and support system results in an economic bridge construction that is easy to fabricate and is ideally suited to resist compressive and tensile forces acting either longitudinally or transversely of the bridge.

The longitudinal and transverse members forming the grid system give strength to the bridge along those respective directions at the top surface of the concrete fill. The transverse members are notched and welded at the intersection with the longitudinal members so that the grid system is firmly integrated.

It will be appreciated from the above, that both the upper and lower surfaces of the concrete fill material are reinforced in both longitudinal and transverse directions so as to resist both compressive and tensile forces in both of these directions. This feature of the deck construction, of course, deters and prevents cracking of the concrete fill, thus adding life to the deck and minimizing maintenance costs of the deck. In one embodiment of the bridge deck, the connection system between the base plate and the grid system takes the form of a plurality of cylindrical studs welded at their lower ends to the base plate and at their upper ends to the grid system at the points of intersection between the longitudinal and transverse members. The studs are thus uniformly dispersed throughout the concrete fill allowing for transverse or shear forces through the concrete without placing excessive stress on the concrete fill.

Other embodiments of the connection system could include the replacement of selected ones of the longitudinal grid members with beams which bridge the space between the base plate and the grid system. The beams, of course, would be welded to the base plate or otherwise securely fastened thereto so as to firmly support the grid system in spaced relationship relative to the base plate. In still another embodiment of the deck system, steel plates can be cut in a preselected pattern into a plurality of webs which are welded together in a criss-crossing pattern with provisions made to allow a continuous flow of the concrete fill material into the spaces between the webs. Each of the above identified deck systems will of course be described in more detail hereinafter.

While the support system for the bridge deck could take numerous forms, the system disclosed herein includes longitudinally extending main support members and longitudinal stringers. Floor beams and cross beams run transversely to and are interconnected with the main support members and longitudinal stringers respectively. All members of the support system are preferably beams of inverted "T" shaped cross section, except for the floor beams, which are conventional "I" shaped beams.

The web portion of the longitudinal stringers and cross beams is welded directly to the underside of the base plate to form an integral connection therebetween. Diaphragms between selected stringers can be used to effectively integrate the deck with the floor beams thus resulting in the deck becoming the top flange of the floor beam.

BRIEF DESCRIPTION OF THE DRAWINGS

FIG. 6 is a fragmentary perspective view of the second embodiment of the bridge deck of the present invention and a portion of the supporting floor structure with the concrete removed from the grid.

FIG. 7 is an enlarged fragmentary perspective view of the grid system shown in FIG. 6.

DESCRIPTION OF THE PREFERRED EMBODIMENT

Figure 1:
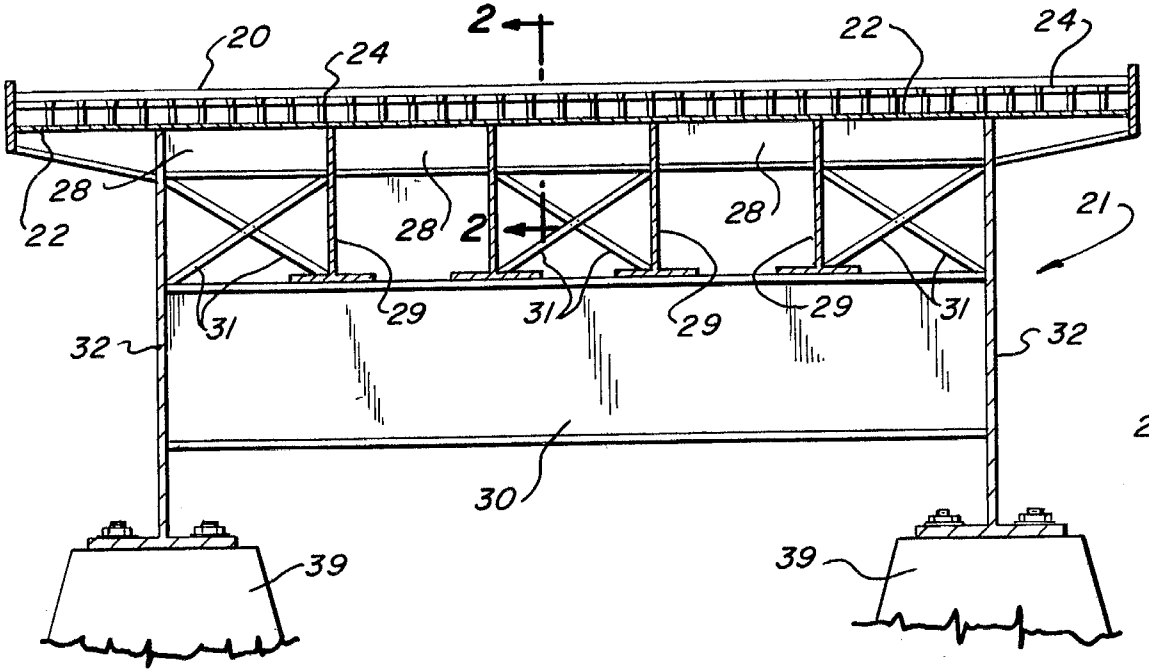
FIG. 1 shows a typical cross section of a deck girder highway bridge utilizing the bridge deck of the present invention and illustrating the structural integration of the grid with all supporting members.

A sectional view of a highway bridge constructed in accordance with the present invention is shown in FIG. 1. The roadway itself includes a bridge deck 20 having an integral base plate 22 rigidly connected to a superimposed criss-crossing grid system 24 of longitudinal and transverse members. The road surface is formed from a hard fill material like concrete (See FIG. 4) which fills the space between the base plate 22 and the top of the grid system 24. The entire bridge deck 20 in the preferred embodiment is integrally supported by a support system 21 of longitudinally extending and transversely extending beams. As a result of the criss-crossing nature of the grid system, the integral base plate construction and the longitudinally and lateral extending beams of the support system 21, the bridge construction is ideally adapted to handle both longitudinal and transverse forces through the grid system 24, base plate 22 and support system 21. Tensile and compressive loads are resisted by the bridge deck 20 through the base plate, concrete fill and the grid system and these loads are further transferred into the integrated supporting structure for the bridge deck in a manner which will become more clear with the description hereafter.

The base plate 22 is constructed from steel plate. In practice, several plates are joined together by welding or bolting. Once assembled from component steel plates, the base plate 22 forms a continuous lower surface for the deck 20 (FIG. 1). The base plate supports the concrete fill along a lower surface thereof, as well as the grid system 24 which is held in a superimposed parallel relationship to the base plate 22.

Figure 4:
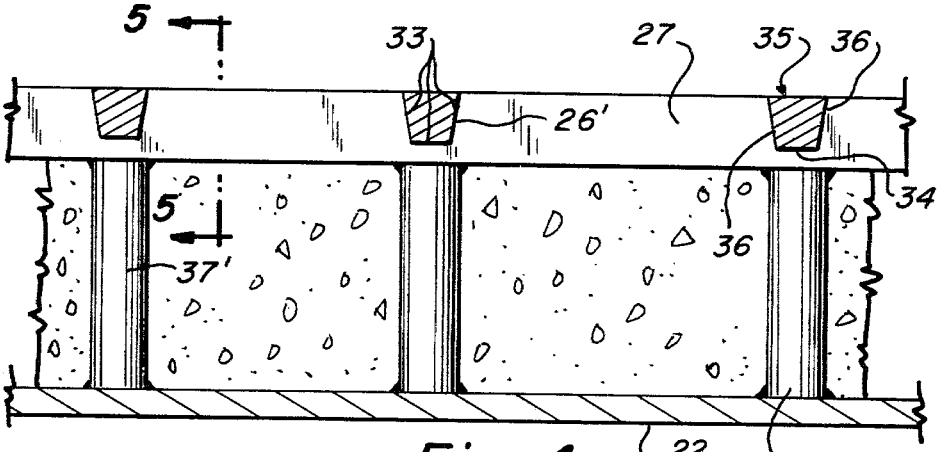
FIG. 4 is an enlarged section taken along line 4—4 of FIG. 3.
Figure 5:
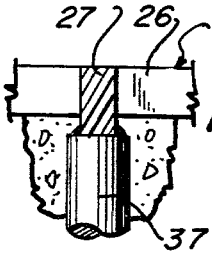
FIG. 5 is a section taken along line 5—5 of FIG. 4.
Figure 3:
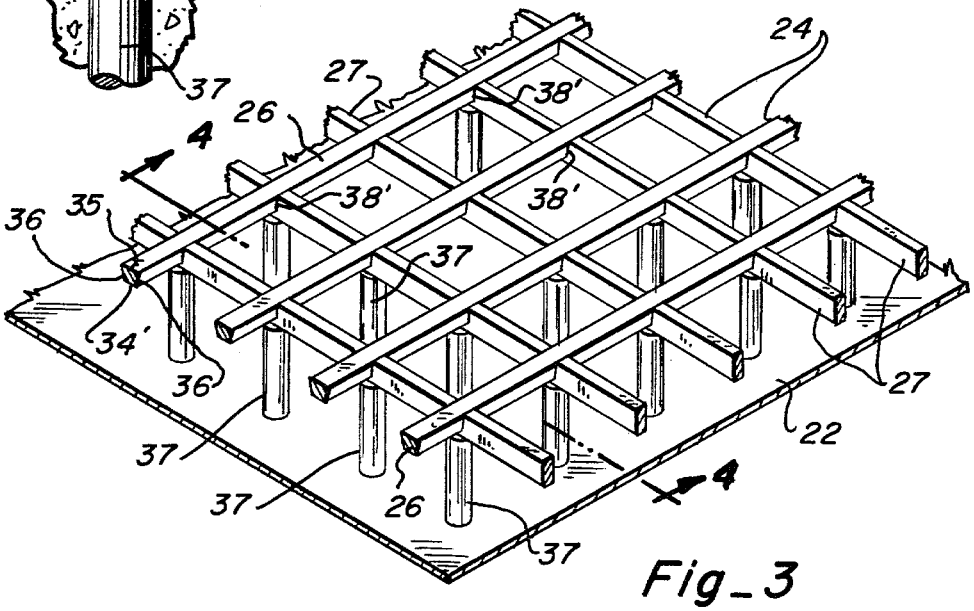
FIG. 3 is a fragmentary perspective view of a first embodiment of a bridge deck of the present invention.

The grid system 24 consists of longitudinal grid members 26 which are perpendicularly intersected at preselected positions along the length thereof by transverse grid members 27 (FIGS. 3, 4 and 5). The longitudinal members are formed of structural steel having a trapezoidal transverse cross section. The trapezoidal cross section is defined by a wide horizontal top side 35 which is in parallel relationship with a narrow horizontal bottom side 34. A pair of downwardly converging sides 36 complete the trapezoidal shape. The transverse members are of rectangular cross section with the longer side extending substantially vertically.

At the intersection between the longitudinal members 26 and the transverse members 27, the transverse members have an upwardly facing notch 33 (FIG. 4) to receive an associated longitudinal member. At the intersection between the respective members, a contact weld interconnects the members 26 and 27. The intersection between the longitudinal and transverse members defines geometrical openings in the grid system 24. The spacing and size of the longitudinal and transverse members is varied to suit the specifications, but most commonly the spacing between longitudinal members and between transverse members will form a square or rectangle on the order of four to six inches on a side.

The grid system 24 is connected to the base plate 22 and held in a superimposed parallel relationship above the base plate 22 by a plurality of cylindrical studs 37 welded at a bottom end to the base plate and at a top end to a transverse member at the intersection between a longitudinal member 26 and a transverse member 27 (FIGS. 3, 4 and 5). In this manner the studs are interspersed equally throughout the concrete fill. These vertically interspersed studs give the concrete fill the ability to equalize longitudinal and transverse forces acting on the deck thereby further rigidifying the deck. Further, as a direct result of this unique construction, the concrete is protected from tensile forces which previously have been a severe problem due to an inherent weakness of concrete in handling tensile forces. The concrete fill is therefore less likely to crack, spall or erode away as a result of forces applied thereto by temperature changes, shrinkage, or other such causes.

The longitudinal members 26 and transverse members 27 of the grid system 24 give the upper surface of the deck 20 strength from both a compressive and tensile standpoint while the integral base plate 22, being constructed of steel plate, handles similar forces equally well along the lower surface of the deck. The studs 37, which tie the grid system to the base plate, and the concrete fill serve to further strengthen the deck and to transfer shear forces throughout the deck.

The support system 21 for the bridge deck is connected to the underside of the base plate 22. While various support systems could be utilized, for purposes of the present disclosure, the support system 21 is constructed from a plurality of main support members or girders 32 connected to and longitudinally spanning piers or abutments 39 beneath the bridge deck 20. Floor beams 30, of "I" cross section, laterally interconnect the main girders 32 at preselected locations. Longitudinal stringers 29 which are of inverted "T" cross section (FIG. 1), are connected to and rest upon the upper flange of the floor beams so as to run longitudinally beneath the bridge deck in support thereof. Cross beams 28, again of inverted "T" cross section, extend laterally beneath the bridge deck 20 interconnecting longitudinal stringers 29. It will thus be seen that the support system 21 further supplements the strength in the bridge deck by providing integrated longitudinal and transverse support means.

Figure 2:
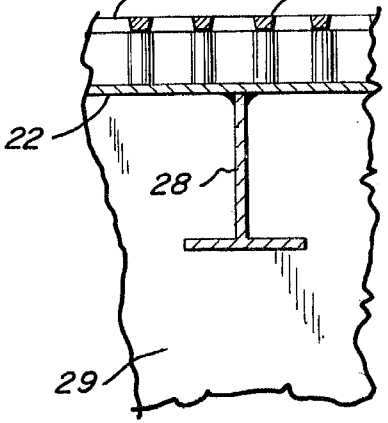
FIG. 2 is a section view taken along line 2—2 of FIG. 1.

The support system 21 is integrally connected to the bottom of the base plate 22 (FIGS. 1 and 2) by welding the upper edge of the web of the longitudinal stringers and cross beams 28 to the base plate 22. Further integration of the deck with supporting members is accomplished by introducing diaphragms 31 between selected stringers thus using the deck as the top flange of the floor beams for part of the dead load and all of the live load on the bridge.

The bridge construction of the invention is thus an integral unit. Forces applied at the surface of the road are carried directly by the grid system 24, and in turn transferred to the stringers, cross beams and girders, for all of which the deck also serves as the top flange.

The bridge deck 20 constructed in accordance with the present invention therefore becomes an integral part of the support system 21 and main support members or girders 32. This construction permits the base plate 22 of the bridge deck 20 to be effectively utilized as part, or as described above, all of the top flanges of the cross beams 28, longitudinal stringers 29 and girders 32 and to thereby resist the compressive or tensile forces normally applied to the relatively narrow top flanges of those members. This feature contributes to substantial economy in the entire bridge deck structure due to the usage of less steel in the supportive system. Use of the aforedescribed bridge deck construction also greatly increases the strength of the support system 21 so that the bridge deck and support system are mutually supportive. Thus, the sizes of the longitudinal stringers 29 both as to web height and flange thickness and width can be reduced. Reduced height of the web of the stringer means less weight and less steel. Similarly, the sections of floor beams and main girders and steel weights thereof may be substantially reduced, In a study made to substitute the deck construction of this invention, for a conventional concrete slab on long span girders to carry a very wide roadway, it was determined that only four main girders would be required with the bridge deck of the present invention as compared to six for the concrete slab bridge deck.

A second embodiment of a grid system for the present invention is shown in FIGS. 6 and 7, wherein like parts have been given like numerals with a prime suffix. In this embodiment, instead of supporting the grid system 24' with studs 37, selected ones of the longitudinal grid members 26' are replaced by "I" beam half sections 40. The "I" beam half sections include a conventional web portion 41 as well as a trapezoidal configured flange 42 of similar shape to the cross section of the longitudinal members 26'. Preferably a full "I" beam is divided midway along the height of the web, to form two identical half sectioned "I" beams 40 for use in the grid system. The half sections are welded to the base plate 22' along the edge of the web opposite the flange 42, in a longitudinal orientation parallel to the longitudinal members 26'. The transverse members in this embodiment are similar to the longitudinal members in cross section, i.e. they are of trapezoidal configuration. Both longitudinal and transverse members are notched to half depth at points of intersection and pressure contact welded together. The longitudinal members 26' are inverted as compared to longitudinal members 26 to thereby form an interlocking relationship between members 26' and 27'.

Figure 9:
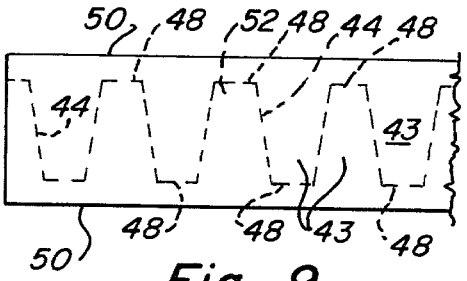
FIG. 9 is a fragmentary plan view of a metal plate from which grid members are cut for the deck shown in FIG. 8; a sinusoidal sawtooth cutting pattern being shown in dotted line.
Figure 10:
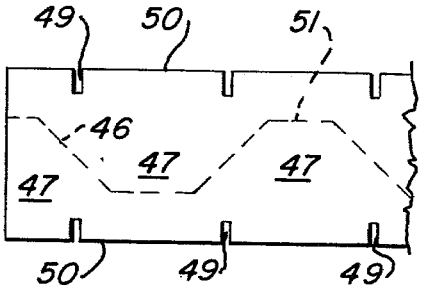
FIG. 10 is a fragmentary plan view of a metal plate from which other grid members are cut for the bridge deck shown in FIG. 8; an elongated sinusoidal sawtooth cutout pattern being shown in dotted line.
Figure 8:
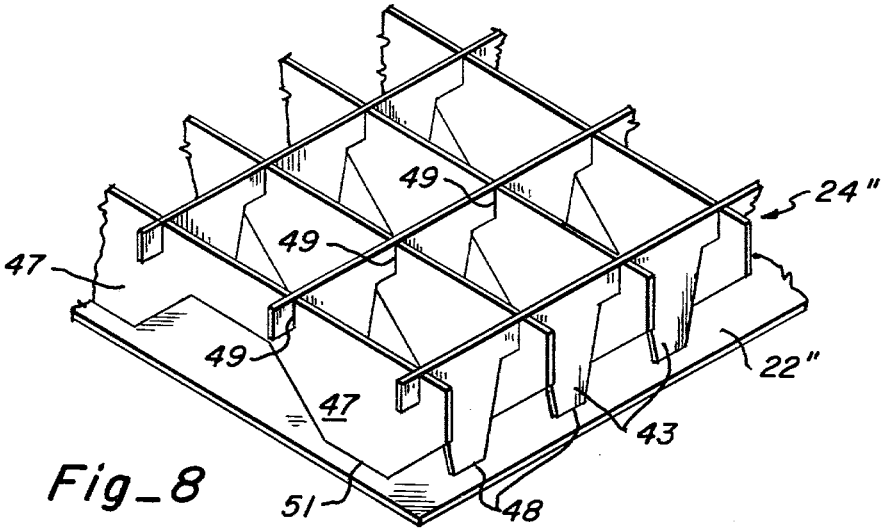
FIG. 8 is a perspective view of another alternative embodiment of the bridge deck of the present invention utilizing a different grid system.

A third embodiment of the grid system is shown in FIGS. 8 through 10 with like parts having been given like numerals with a double prime suffix. In this embodiment, the grid system 24'' is constructed totally from steel plate material. Longitudinal grid members 43 (FIG. 9) are sheared or flame cut from a single plate of sheet metal along a sinusoidal sawtooth pattern 44. Transverse grid members 47 are likewise cut from a single piece of sheet metal along an elongated sawtooth sinusoidal pattern 46, resulting in a castellated plan view (FIGS. 9 and 10). Straight sides 50 are left at each side opposite the cut forming the longitudinal members 43 or transverse members 47.

The transverse members 47 have slots 49 along sides 50 at spaced increments corresponding to valleys 48 in the longitudinal members 43. In this manner the valleys of the longitudinal members can be fitted into the slots 49 of the transverse members to form a grid system 24'' (FIG. 10).

Fillet welds join the transverse members 47 to the longitudinal members 43. The entire grid system 24'' is welded at the peaks 52 of the longitudinal members and at the peaks 51 of the transverse members to the base plate 22'' (FIG. 8).

Figure 11:
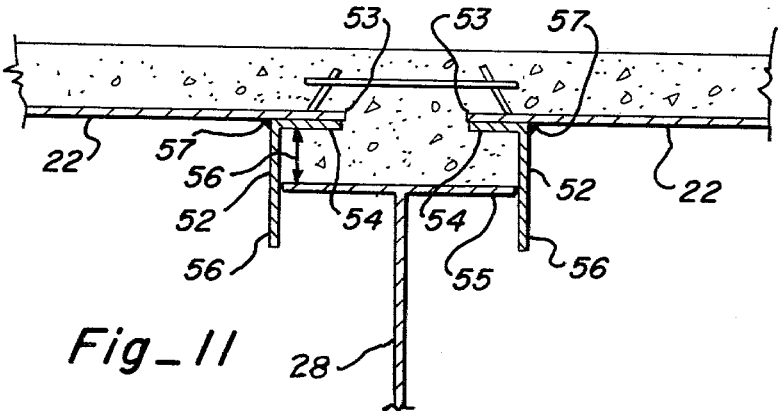
FIG. 11 is a longitudinal vertical section of one possible connection between the bridge deck of the present invention and the supporting members of the floor system or main girders.

The bridge decks 20, 20' or 20'' are of modular construction so that several modules can be joined together to form the bridge 21. Base plates 22, 22', or 22'' are formed from several steel plates forming a portion of each module. The separate plates can be bolted or welded together to form the integral base plate 22. One system for joining these plates to a cross beam 28 or longitudinal stringer 29 is illustrated in FIG. 11. As seen in FIG. 11, edges 53 of adjacent plates are joined by a structure including pieces of angle iron 52 running the entire length of the supporting member. One leg 54 of the angle iron is rigidly connected, as by welding at 57, to the undersurface of the base plate. A flange 55 of a cross beam 28 or other supporting members fits against an interior surface of the other leg 56 of the angle iron in a perpendicularly abutting relationship. When two adjacent plates are positioned as illustrated in FIG. 11, the flange 55 is abutted at both ends by the legs 56 of the angle irons. The angle irons are then welded to the flange along their abutment therewith. This particular method of assembly allows for considerable tolerances in camber of the floor beam, cross beam, longitudinal stringers or main girders which may be necessary to minimize cost of fabrication and erection. In the final construction, an integral base plate 22 is formed.

Under the construction taught by the present invention, a buffer zone 56 extends between the bottom of the base plate and the top of the flange of the cross beam, floor beam or stringer. Into this buffer zone, after the angle iron 52 has been welded to the flange 55 of the floor beam, cross beam, stringer or girder, concrete is permitted to flow and form a strong connection between adjacent base plates while the base plates remain at a preselected level regardless of the camber of the supporting beam.

Although the present invention has been described with a certain degree of particularity, nothing contained herein shall serve to limit the scope of the invention, particularly as defined in the appended claims.

What is claimed is:

1. An elongated bridge construction including a support structure and a deck system, said support structure including structural support members at least some of which have a vertically oriented web of substantially uniform thickness having a top edge, said deck system being fixedly connected directly to said top edges and having means for providing substantially equal structural strength in both longitudinal and transverse directions relative to the length of the bridge.

2. The elongated bridge construction of claim 1 wherein said deck system includes:

a continuous base plate integrally connected to said top edges;

a grid system of criss-crossing grid members;

means for supporting the grid system in vertically spaced relationship above said base plate, said means for supporting the grid system being integrally connected to the grid system and the base plate; and a hard material filling the space between said base plate and grid work.

3. The bridge construction of claim 1, wherein said grid members include longitudinal grid members extending substantially along the length of said bridge construction, and transverse grid members extending substantially perpendicularly to said longitudinal grid members, said longitudinal and transverse grid members being interconnected at selected locations.

4. The bridge construction of claim 1, wherein said support structure is integrally connected to said base plate.

5. The bridge construction of claim 4, wherein said structural support members are constructed of longitudinally and laterally extending beams, at least some of which are of inverted "T" shape in cross section, an upper edge of said inverted "T" shaped beams being welded to said base plate.

6. The bridge construction of claim 3 wherein said longitudinal and transverse grid members are of substantially identical construction.

7. The bridge construction of claim 6 wherein at least some of said grid members are of trapezoidal transverse cross section.

8. The bridge construction of claim 3 wherein said means for supporting the grid members consist of a plurality of spacer studs secured at one end to said grid work and at the other end to said base plate.

9. The bridge construction of claim 8 wherein said spacer studs are of cylindrical configuration.

10. The bridge construction of claim 3 wherein some of said grid members are of a different depth than the other of the grid members with the deeper grid members resting on the base plate thereby forming the means for supporting the grid work above said base plate.

11. The bridge construction of claim 10, wherein said deeper grid members are secured to said base plate.

12. The bridge construction of claim 3 wherein most of said longitudinal grid members are of trapezoidal transverse cross section and said transverse grid members are of rectangular transverse cross section.

13. The bridge construction of claim 12 wherein each of said transverse grid members includes a plurality of longitudinally spaced notches in an upper surface thereof and most of said longitudinal grid members extend through associated notches of adjacent transverse grid members.

14. The bridge construction of claim 6 wherein said hard material is concrete.

15. The bridge construction of claim 14 wherein said concrete is filled to a level flush with the top of said grid system.

* * * * *